US006718654B1

(12) United States Patent
Westman

(10) Patent No.: US 6,718,654 B1
(45) Date of Patent: Apr. 13, 2004

(54) DEVICE AND METHOD IN CONNECTION WITH THE MANUFACTURING OF PAPER OR CARDBOARD

(75) Inventor: Lennart Westman, Grycksbo (SE)

(73) Assignee: Stora Kopparbergs Bergslags Aktiebolag (publ), Falun (SE)

( * ) Notice: Subject to any disclaimer, the term of this patent is extended or adjusted under 35 U.S.C. 154(b) by 0 days.

(21) Appl. No.: 10/111,766

(22) PCT Filed: Oct. 6, 2000

(86) PCT No.: PCT/SE00/01935

§ 371 (c)(1),
(2), (4) Date: May 23, 2002

(87) PCT Pub. No.: WO01/31121

PCT Pub. Date: May 3, 2001

(30) Foreign Application Priority Data

Oct. 27, 1999 (SE) ..... 9903864

(51) Int. Cl.[7] ..... F26B 3/00

(52) U.S. Cl. ..... 34/444; 34/454; 34/466; 34/499; 34/117; 162/206; 162/358.3

(58) Field of Search ..... 34/454–457, 458, 34/462, 466, 482, 483, 498, 499, 110–117, 120, 123, 126, 614, 618, 646; 162/202, 206, 208, 358.1–358.5

(56) References Cited

U.S. PATENT DOCUMENTS 4,955,268 A * 9/1990 Ickinger et al. ..... 492/46
5,110,417 A * 5/1992 Lehtonen et al. ..... 162/358.3
5,894,679 A * 4/1999 Kuhasalo et al. ..... 34/117
6,458,248 B1 * 10/2002 Edwards et al. ..... 162/361
6,490,811 B1 * 12/2002 Wahlstrom ..... 34/114
6,517,672 B2 * 2/2003 Edwards et al. ..... 162/109
6,551,457 B2 * 4/2003 Westman et al. ..... 162/158

FOREIGN PATENT DOCUMENTS

| | | |
|---|---|---|
| DE | 195 40 003 A1 | 5/1997 |
| DE | 196 02 697 A1 | 6/1997 |
| WO | 93/23615 | 11/1993 |

* cited by examiner

*Primary Examiner*—Henry Bennett
*Assistant Examiner*—Camtu Nguyen
(74) *Attorney, Agent, or Firm*—Nixon & Vanderhye

(57) ABSTRACT

Device for a drying section useful in the manufacture of paper or paperboard as a fibrous web. The drying section includes a drying drum rotatable about a first axis of rotation and arranged such that the fibrous web runs in contact with a surface of the drying drum, at least about a part of its circumference, and is dried thereby. The device includes at least one press roller rotatable about a second axis of rotation which is essentially parallel with the first axis of rotation, and is arranged, with a line load, to bear against the fibrous web, whereby the drying drum supports the at least one press roller. The at least one press roller is positioned at a corresponding longitudinal edge of the fibrous web, the least one press roller having a first cross-sectional diameter (D) at outer short ends in the device, and a second cross-sectional diameter (d) at inner short ends of the device, the first cross-sectional diameter (D) being larger than the second cross-sectional diameter (d).

10 Claims, 3 Drawing Sheets

DEVICE AND METHOD IN CONNECTION WITH THE MANUFACTURING OF PAPER OR CARDBOARD

TECHNICAL FIELD

The present invention relates to a device and a method for a driving section in connection with the manufacturing of paper or paperboard as a fibrous web which drying section comprises a drying drum which drying drum is rotatable about a first axis of rotation and is arranged such that the fibrous web is brought to run in contact with the surface of the drying drum, at least about a part of its circumference and to be dried by the same.

PRIOR ART

At the manufacturing of paper or paperboard in a paper or paperboard machine a fibrous web, having a relatively low dry substance content, is first formed on a wire. Thereafter, the fibrous web is dewatered in a press section, in order to subsequently proceed to a drying section for additional enhancing of the dry substance. The limit in dry substance, between the press section and the drying section, could be said to be about 40–50% dry substance. The fibrous web leaves the drying section at a dry substance of about 90–95%, in order to thereafter be further treated in the form of glossing, coating, lamination etc.

In the drying section, the fibrous web runs in abutment against a number of drying drums. Typically, the drying section comprises about 20–40 drying drums. Thereby, the fibrous web runs up and down, in ziezag, between these drying drums, abutting the surfaces of the drying drums at about half of their respective circumference. An endless drying wire is arranged to support the fibrous web along a part of the section against which the fibrous web abuts the surface of the drying drum. Usually, the drying drums are heated, normally by steam, and the fibrous web is dried against each drying drum by heat transfer to the fibrous web, or to its content of moist.

In connection with conventional drying sections, there is a problem in that the fibrous web tends to contract, i.e to shrink, along its longitudinal edges, in the cross direction (CD) for the paper or paperboard machine, whereby it will instead increase in thickness (z) alone the longitudinal edges. This leads to an increase in basis weight, thickness and surface coarseness in the area of the longitudinal edges, in relation to the case if no cross directional shrinking had occurred. As a result of this, the longitudinal edges may exhibit flaws in the edge and an uneven paper or paperboard quality.

In its turn, this will cause problems in subsequent post treatment. In connection with blade coating e.g., disruptions will arise due to the uneven edge quality and moreover the coating result will be uneven. Also, the blade which is used for the blade coating will be more rapidly worn at the edges as compared to its more central parts, as seen in CD, which causes it to be exchanged unreasonably often. In particular, this is a problem in connection with the use of a soft tip blade.

The increase in basis weight, thickness and surface coarseness may also impair other post treatment of the paper. This may e.i. be the case for glossing or calendering.

BRIEF ACCOUNT OF THE INVENTION

The present invention aims at diminishing or eliminating the above problems, by providing a device and method for a drying section, by use of which even longitudinal edges may be attained in the fibrous web. When the invention is used, the fibrous web will accordingly exhibit essentially the same surface coarseness and thickness along the area of its longitudinal edges as in the more central part of the fibrous web, as seen in CD. Hereby, a subsequent coating is facilitated, which coating will have a more even result and will wear the coating equipment less. The wearing may especially be decreased in case of a soft tip being used in blade coating.

Another advantage which is attained by levelling of the edge is that impurities (e.g. fibrous clumps, shives or alien objects) also are pressed into the web. Thereby, their possible effect in causing disruptions in subsequent treatment. e.g. coating, glossing or super-calendering, is decreased.

According to the invention, this is achieved by a device for a drying section useful in the manufacture of paper or paperboard as a fibrous web (5). The drying section comprises a drying drum (1) which is rotatable about a first axis (2) of rotation and is arranged such that the fibrous web is brought to run in contact with the surface of the drying drum, at least about a part of its circumference, and to be dried thereby. The device includes a press roller (7, 9), which is rotatable about a second axis (8) of rotation which is essentially parallel with the first (2) axis of rotation, and arranged to, with a line load, bear against the fibrous web (5), whereby the drying drum (1) constitutes a support to the press roller (7, 9), At least one press roller (7) is arranged at a corresponding longitudinal edge (6) of the fibrous web (5).

The invention also provides a method for manufacturing a fibrous web of paper or paperboard in which the fibrous web is dried in a drying section and in which a line load is applied against the fibrous web. The line load is only applied at the longitudinal edges of the fibrous web.

According to the invention, it has thus been discovered that a relatively simple action, in the form of the application of a line load at the longitudinal edges of the fibrous web, in the drying section, will give a surprisingly good effect on the longitudinal edges of the fibrous web, as a decreased surface coarseness and thickness.

The device according to the invention is realised by means of a line load-giving, rotatable press roller, which is arranged to have a rotatable drying drum as a support for the line load, which Press roller may have the same extension in CD as the drying drum, or at least as the fibrous web, or may have an extension only in the area of the longitudinal edges of the fibrous web, in which case at least one press roller is arranged at the respective longitudinal edges. The press roller/rollers has/have an axis of rotation which is essentially parallel with the axis of rotation of the drying drum. The press roller and the drying drum are rotating in opposite directions to each other. The press rollers may, at their outermost short ends, overlap the longitudinal edges of the fibrous web, or, they may end in phase with the longitudinal edges of the fibrous web.

The concept of "essentially parallel" will here comprise a small angle deviation, the object of which may be to achieve a line load which varies along the length of the press roller/rollers.

The device is, according to one aspect of the invention, arranged to operate at a dry substance of about 50–95%, preferably about 60–90% and even more preferred about 70–90%, in the fibrous web. Thereby, the press rollers may be arranged in connection with one drying drum only, or in connection with a number of drying drums.

According to another aspect of the invention, the press roller/rollers is/are arranged in a position which corresponds to the inlet of the fibrous web to, or the outlet from, the drying drum, in which position the fibrous web runs freely, i.e. without a drying wire.

DESCRIPTION OF DRAWINGS

In the following, the invention will be described with reference to the drawings, of which:

Detail number 1 in FIGS. 1 and 3 is representing a steam heated drying drum which is rotatable about a first axis of rotation 2, and which has a diameter of typically 1–2 m. In this respect. FIG. 1 is shown in perspective, as seen obliquely from above, or obliquely from below if the shown drying drum is constituting an upper drying drum. The rotation of the drying drum is driven by non shown driving means. The drying drum 1 is abutting an endless drying wire 3, with a lower circular segment of its shell, which drying wire is held up by a rotatable roller 4 on each side of the drying drum 1, as seen in the machine direction (MD). The fibrous web 5, the longitudinal edges 6 of which are shown by broken lines, is entering from above to one side of the drying drum 1, and is emerging from the drying drum on its other side, as shown by the arrows. In the lowermost part of the device, the fibrous web is running between the shell of the drying drum and the drying wire.

Figure 1:
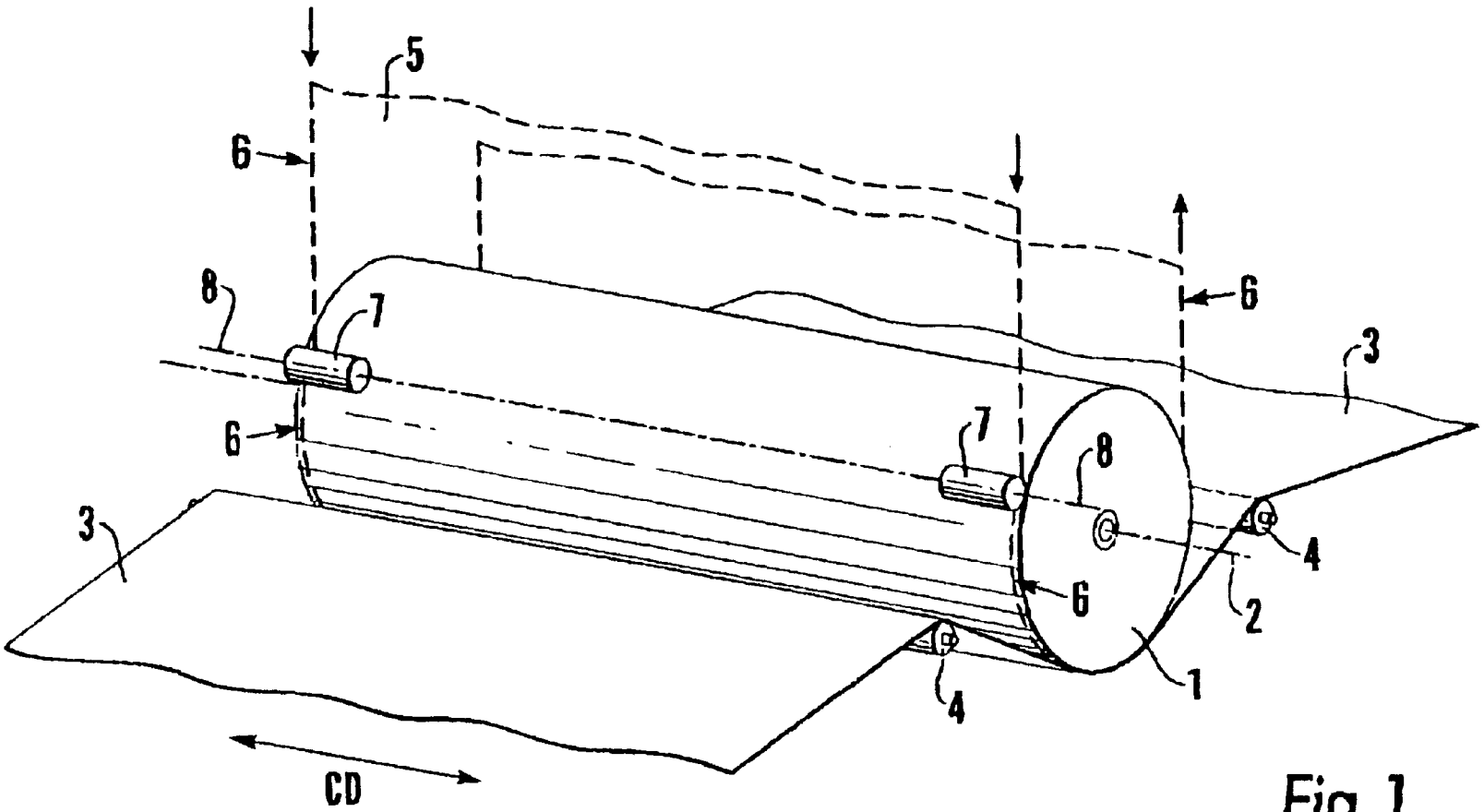
FIG. 1 is schematically showing a preferred embodiment of the device according to the invention, as seen in a perspective.

A press roller 7 is, according to the invention, arranged in a position which preferably corresponds to the inlet of the fibrous web to the drying drum 1, at both ends of the shell of the drying drum, i.e. at the longitudinal edges 6 of the fibrous web, which edges bear against the corresponding end of the shell of the drying drum. The press rollers 7 are rotatable about a second axis of rotation 8, by a not shown, possibly common, drying means, which second axis of rotation is essentially parallel with said first axis of rotation 2 for the drying drum 1 (and also with axes of rotation for the support rollers 4 for the drying wire 3). As an alternative, the press rollers may be arranged without a drive of their own. The press rollers 7 are arranged to be pressed against the longitudinal edges 6 of the fibrous web 5, the line load being adjustable. Thereby, the line load should be large enough to be able to compress the fibrous web along its longitudinal edges, whereby it is to be realised that the required line load varies in the production of different paper or paperboard qualities. The line load compresses the fibrous web, which in turn leads to the surface coarseness being retained at a desired level. Preferably, the line load is achieved by a mechanical load on the axes of rotation of the press rollers 7, e.g. hydraulically or by an applied weight. Typically, the press roller is arranged to yield a line load of 5–100 kN/m, preferably 5–30 kN/m, on the paper.

Figure 2:
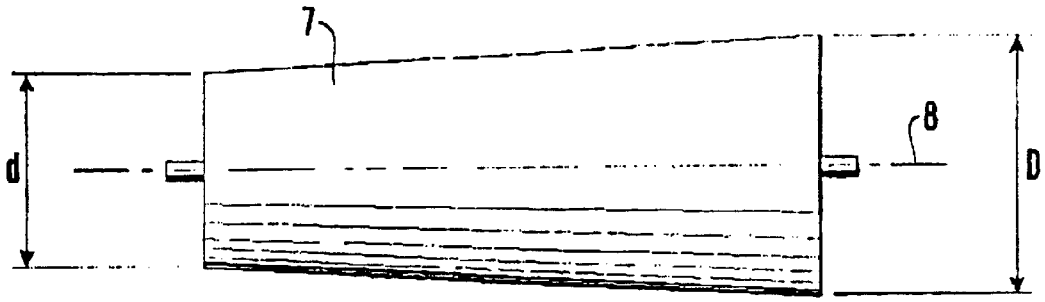
FIG. 2 is showing a conical press roller for the device in FIG. 1, as seen in greater detail in MD.
Figure 3:
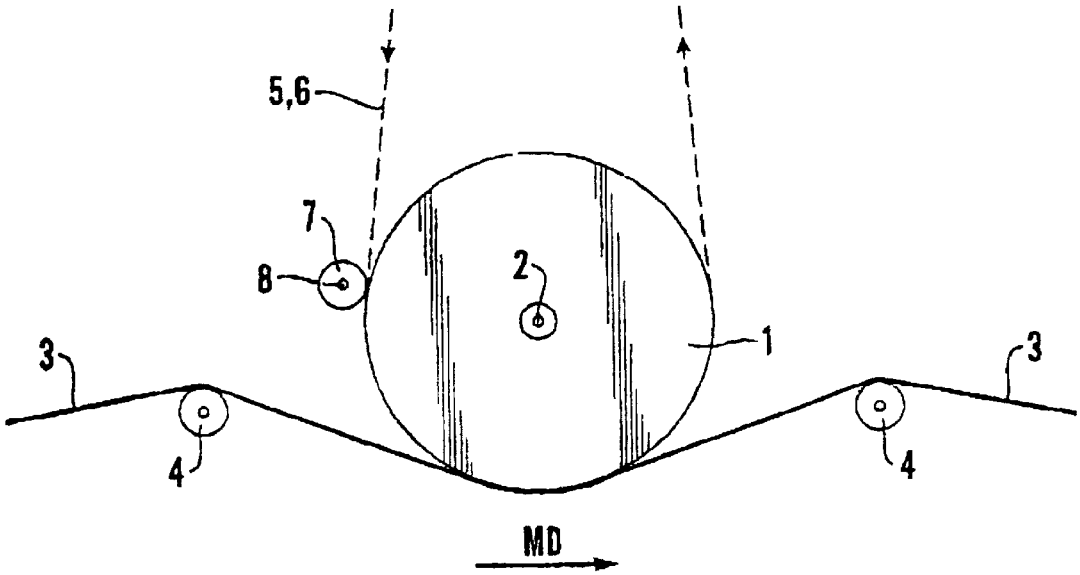
FIG. 3 is showing the device of FIG. 1, as seen from the side.

In FIG. 2, a press roller 7 is shown in greater detail. The press roller 7 is rotationally symmetric about the axis 8, and has a length of 5–50 cm, preferably 10–35 cm. The press roller 7 is designed as a truncated cone, having a first diameter D in one end thereof, which is larger than a second diameter d in the other end of the press roller. Typically. D is 10–50 cm, preferably 20–40 cm, and d is somewhat smaller than D, e.g. 1–5% smaller. The end having the first diameter D is intended to be arranged at the outermost end against the longitudinal edge 6 of the fibrous web, possibly with a small overlap, so that a somewhat larger line load is applied against the longitudinal edge of the fibrous web and is gradually decreased towards the other end of the press roller, which has a more central position in the device, as seen in CD. An object of the press roller having the shape of a truncated cone, is to avoid the formation of a longitudinal indentation in the fibrous web at the end of the press roller. An alternative way of achieving this may be to arrange the axes of rotation 8, 2 of the press roller 7 and the drying drum 1, respectively, so that they are slightly converging towards each other in a direction out from the device. To this end, the press roller 7 may have the same diameter, according to the above, in both ends, as along the entire of its length.

Preferably, the press roller 7 is manufactured to have a smooth surface and preferably it is not heated. The material for the press roller may be dimensionally stable or elastic, e.g. steel or rubber. Possibly, the nip between the press roller and the drying drum 1 may be extended if the material for the press roller is elastic.

Figure 4:
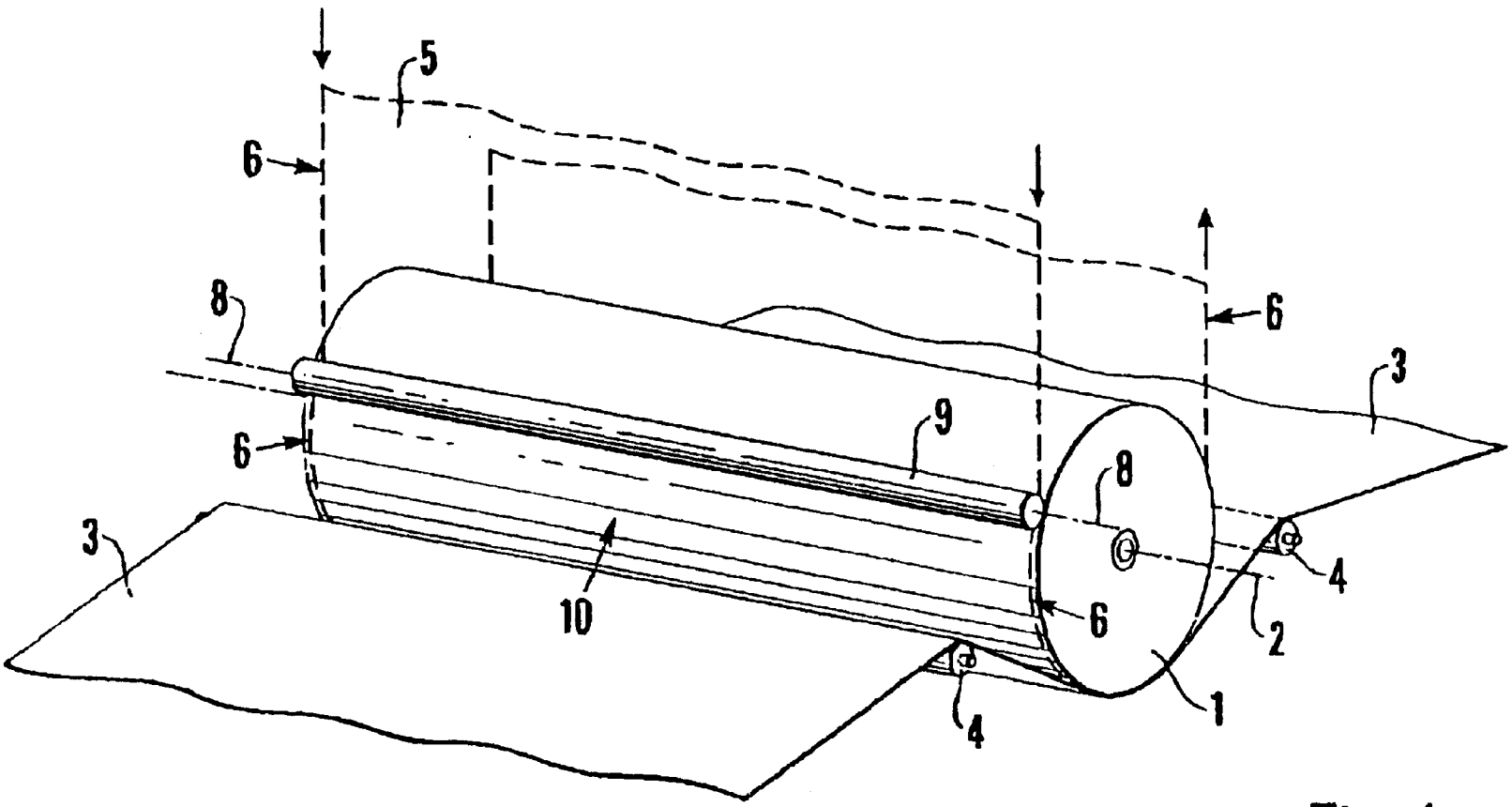
FIG. 4 is schematically showing an alternative embodiment of the device according to the invention, as seen in perspective, obliquely from above.

In FIG. 4, there is shown an alternative embodiment of the device according to the invention, in which a single, long press roller 9 is arranged to bear against the fibrous web, with a line load. Accordingly, the press roller 9 has essentially the same longitudinal extension in the direction of the axes 2, 8 of rotation, as has the drying drum 1, or at least as has the fibrous web 5. In this embodiment, the line load is adjusted so that it is larger along the two longitudinal edges 6 of the fibrous web than along a central part 10 of the fibrous web, which in technical terms is called that the press roller 9 is negatively crowned.

In despite of the embodiment, several press rollers 7, 9 may be used at each longitudinal edge 6 of the fibrous web 5, if this is required in order to give the desired surface coarseness and thickness along the longitudinal edges of the fibrous web. Thereby, it is conceivable also to arrange press rollers on the opposite side of the drying drum, i.e. in connection with the emerging of the fibrous web from the drying drum, or to arrange press rollers in series, i.e. after each other, against the same drying drum, e.g. having a relative angle distance of about 10–30°.

In the figures the invention is shown in connection with a drying drum to which the fibrous web enters from above. It should however be realised that the invention just the same may be used in connection with a drying drum to which the fibrous web enters from another direction, e.g. from below. The invention is also applicable to other types of drying drums, such as e.g. so called Yankee cylinders, which may have considerably larger diameters than the above mentioned drying drums.

EXAMPLE

At the manufacturing of coated fine paper, using simultaneous on-line coating, press rollers according to the present invention were applied during operation at the two longitudinal edges of drying drum number 1, as counted from the coater in direction towards the wire section. The line load which was used was 10 kN/m for each press roller and these had a diameter of 20 cm and were manufactured in hard rubber. Of the length, 6 cm, of the press rollers, 4 cm were positioned on the paper web and the rest outside the web. The press rollers lacked drying of their own.

The base paper had a basis weight of 92 g/m$^2$. The coating was two times 19 g/m$^2$.

The effect of the application was that the thickness of the coated paper decreased from 136 μm to 130 μm in the edges. Two cm in from the edges, the decrease was 3 μm. The wearing of the coater blades, which were of the type having a soft tip, decreased at the paper edges, as compared to ordinary manufacturing without the use of press rollers. Thereby, the operational time of the blades increased, typically to eight days instead of four days.

The invention is not limited by the embodiments described above, but may be varied within the scope of the following claims.

What is claimed is:

1. Device for a drying section useful in the manufacture of paper or paperboard as a fibrous web, which drying section comprises a drying drum rotatable about a first axis of rotation and arranged such that said fibrous web runs in contact with a surface of said drying drum, at least about a part of its circumference, and to be dried thereby, said device comprising at least one press roller rotatable about a second axis of rotation which is essentially parallel with said first axis of rotation, and arranged, with a line load, to bear against said fibrous web, whereby said drying drum supports said at least one press roller, said at least one press roller being positioned at a corresponding longitudinal edge of said fibrous web, said at least one press roller having a first cross-sectional diameter (D) at outer short ends in the device, and a second cross-sectional diameter (d) at inner short ends of the device, said first cross-sectional diameter (D) being larger than said second cross-sectional diameter (d).

2. Device according to claim 1, wherein it is arranged to operate at a dry substance content of about 50–95% in said fibrous web.

3. Device according to claim 2, wherein it is arranged to operate at a dry substance content of about 60–90% in said fibrous web.

4. Device according to claim 3, wherein it is arranged to operate at a dry substance content of about 70–90%, in said fibrous web.

5. Device according to claim 1, wherein said press roller is arranged in a position which corresponds to an inlet of said fibrous web to, or outlet from, said drying drum.

6. Device according to claim 1, wherein said press roller is arranged to give a line load of 5–100 kN/m.

7. Device according to claim 6, wherein said press roller is arranged to give a line load of 5–30 kN/m.

8. Device according to claim 1, wherein said press roller has a longitudinal extension of 5–50 cm in the direction of said second axis of rotation, and a diameter of 10–50 cm.

9. Device according to claim 8, wherein said press roller has a longitudinal extension of 10–35 cm, in the direction of said second axis of rotation, and a diameter of 20–40 cm.

10. Device for a drying section useful in the manufacture of paper or paperboard as a fibrous web, which drying section comprises a drying drum rotatable about a first axis of rotation and arranged such that said fibrous web runs in contact with a surface of said drying drum, at least about a part of its circumference, and to be dried thereby, said device comprising at least one press roller rotatable about a second axis of rotation which is arranged, with a line load, to bear against said fibrous web, whereby said first axis of rotation and said second axis of rotation, for a corresponding press roller, slightly converge towards each other in a direction out from the device.

* * * * *